US005897389A

United States Patent [19]

Dietz et al.

[11] Patent Number: 5,897,389

[45] Date of Patent: Apr. 27, 1999

[54] ELECTRICAL CONNECTOR ASSEMBLY WITH SHORTING CIRCUIT ARRANGEMENT

[75] Inventors: Holger Alexander Dietz, Ettlingen; Benno Otto Reis, Rheinstetten, both of Germany

[73] Assignee: Molex Incorporated, Lisel, Ill.

[21] Appl. No.: 08/949,116

[22] Filed: Oct. 10, 1997

[30] Foreign Application Priority Data

Nov. 4, 1996 [EP] European Pat. Off. ..... 96117611

[51] Int. Cl.[6] ..... H01R 29/00

[52] U.S. Cl. ..... 439/188; 200/51.1

[58] Field of Search ..... 439/188; 200/51.1, 200/51.11, 51.09; 339/176

[56] References Cited

U.S. PATENT DOCUMENTS

| | | | |
|---|---|---|---|
| 5,273,448 | 12/1993 | Myer et al. | 439/188 |
| 5,277,608 | 1/1994 | Oda | 439/188 |
| 5,468,163 | 11/1995 | Egenolf | 439/839 |
| 5,494,450 | 2/1996 | Kirsch et al. | 439/188 |
| 5,509,817 | 4/1996 | Tsuji | 439/188 |
| 5,516,299 | 5/1996 | Fukuda et al. | 439/188 |
| 5,516,300 | 5/1996 | Tsuji | 439/188 |

FOREIGN PATENT DOCUMENTS

| | | | |
|---|---|---|---|
| 0 616 397 A2 | 9/1994 | European Pat. Off. | H01R 31/08 |
| 0 655 806 A2 | 5/1995 | European Pat. Off. | H01R 13/629 |
| 6-325832 | 11/1994 | Japan | H01R 13/703 |

*Primary Examiner*—Steven L. Stephan
*Assistant Examiner*—Hae Moon Hyeon
*Attorney, Agent, or Firm*—A. A. Tirva

[57] ABSTRACT

An electrical connector assembly includes a shorting circuit arrangement. The assembly includes a first connector having a dielectric housing mounting at least a pair of adjacent terminals. A pair of conductive shorting members are mounted in the housing of the first connector. Each shorting member includes a contact portion in engagement with a respective one of the terminals and a shorting portion in engagement with the shorting portion of the other shorting member, thereby establishing an electrical shorting circuit between the terminals. A second connector includes a dielectric extending portion received between the shorting portions of the shorting members when the connectors are mated, thereby electrically separating the shorting members and opening the electrical shorting circuit between the terminals.

10 Claims, 2 Drawing Sheets

ELECTRICAL CONNECTOR ASSEMBLY WITH SHORTING CIRCUIT ARRANGEMENT

FIELD OF THE INVENTION

This invention generally relates to the art of electrical connectors and, particularly, to a shorting circuit arrangement in an electrical connector assembly

BACKGROUND OF THE INVENTION

There often is a need to provide an electrical short circuit arrangement between components of an electrical system, such as between a pair of mating electrical connectors For example, a shorting circuit arrangement conventionally is provided in a circuit related to an air bag in an automobile or other vehicle Specifically, air bags are being used extensively to protect passengers of vehicles against the impact of a vehicular crash. The operating circuit for an air bag runs through connecting terminals associated with a gas-generating apparatus to terminals associated with a power source, usually through an impact detector When the impact detector senses a vehicular crash, current flows to the gas-generating apparatus to produce a large amount of gas, thereby inflating the air bag.

Although the air bag must be actuated positively in response to a vehicular crash, it is important that the air bag not be activated accidentally during assembly of the circuitry of the air bag or after assembly, during inspection and/or during maintenance or repair work being conducted on the vehicle in the vicinity of the air bag. Accidental actuation of the air bag may cause serious injury to workers and will incur unnecessary repair expenses. Therefore, it is highly desirable to provide a shorting circuit arrangement to deactivate the operating circuit unless intentionally connected.

Of course, a normally open circuit could be used until the operative connectors of the air bag system are mated. However, simple normally-open circuits create a risk that a magnetic field or an electric field produced around the open terminals could induce a voltage between the open terminals which would cause current to flow to the igniter of the air bag, thus causing the above-mentioned accidental activation.

Heretofore, shorting circuit arrangements have been provided in connector assemblies, such as in air bag systems, by shorting terminals which are opened in response to intentional mating of a pair of connectors. However, such shorting terminals must be manufactured different from the other terminals of the connector, resulting in increased manufacturing and inventory costs. Other shorting circuit arrangements employ plural shorting or shunting circuits which also unnecessary increases the costs of manufacture. The present invention is directed to providing a very simple, cost effective shorting circuit arrangement in such connector systems as in air bag electrical connector systems.

SUMMARY OF THE INVENTION

An object, therefore, of the invention is to provide a new and improved electrical connector assembly which includes a shorting circuit arrangement In the exemplary embodiment of the invention, the connector assembly includes a first connector having a dielectric housing mounting at least a pair of adjacent terminals. A pair of conductive shorting members are mounted in the housing of the first connector. Each shorting member includes a contact portion in engagement with a respective one of the terminals, and a shorting portion in engagement with the shorting portion of the other shorting member, thereby establishing an electrical shorting circuit between the terminals. A second connector includes a dielectric housing having an extending portion received between the shorting portions of the shorting members when the connectors are mated, thereby electrically separating the shorting members and opening the electrical shorting circuit between the terminals.

As disclosed herein each shorting member is formed of metal material and the contact portion is formed by a spring arm resiliently biased into engagement with the respective terminal. The shorting portion is formed by a spring beam resiliently biased into engagement with the spring beam of the other shorting member. Each shorting member includes a base portion fixed to the housing of the first connector, and the spring arm and the spring beam are cantilevered from the base portion.

Still further, each shorting member preferably includes a pair of the shorting portions formed by a pair of spring beams on opposite sides of the contact portion formed by the spring arm. The spring beams are longer than the spring arm, and distal ends of the spring beams are integrally joined by a cross portion of the shorting member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
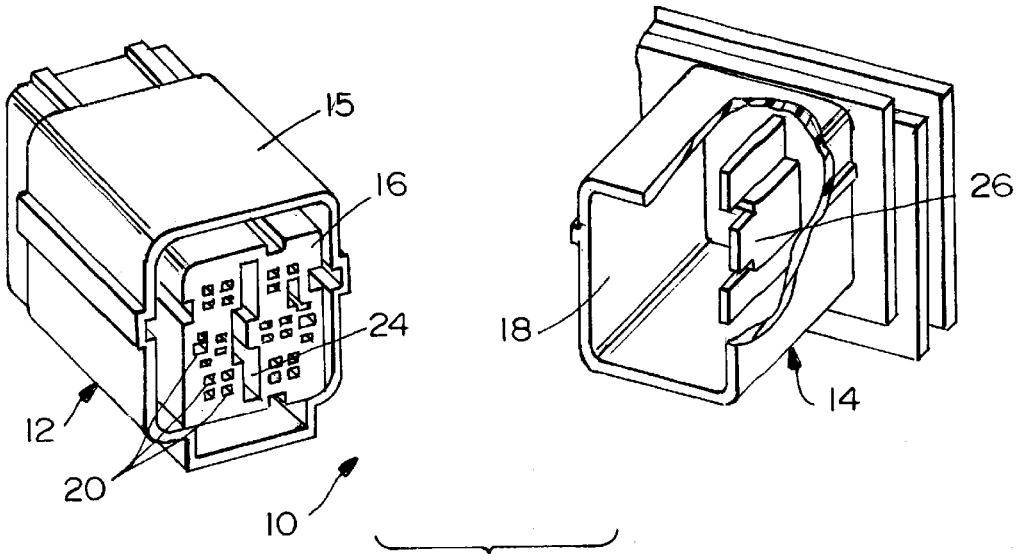
FIG. 1 is a perspective view of an electrical connector assembly including a pair of mating connectors incorporating the shorting circuit arrangement of the invention.

Referring to the drawings in greater detail, and first to FIG. 1, the invention is embodied in an electrical connector assembly, generally designated 10, which includes a first or plug connector, generally designated 12, and a second or receptacle connector, generally designated 14. The plug connector includes a dielectric housing 15 having a plug portion 16 insertable into a dielectric receptacle portion 18 of receptacle connector 14. The plug portion includes a plurality of terminal-receiving passages 20 which mount female terminals for receiving pin terminals 22 (not shown) of receptacle connector 14 when the two connectors are mated. For purposes of the invention, FIG. 1 shows that plug portion 16 of plug connector 12 includes a slot 24 for receiving a dielectric extending portion or rib 26 which extends from receptacle connector 14 within receptacle portion 18.

Figure 2:
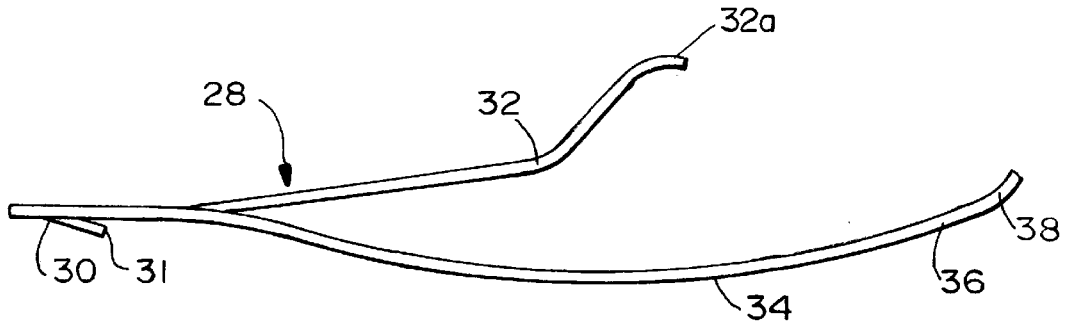
FIG. 2 is a side or edge view of one of the shorting members.
Figure 3:
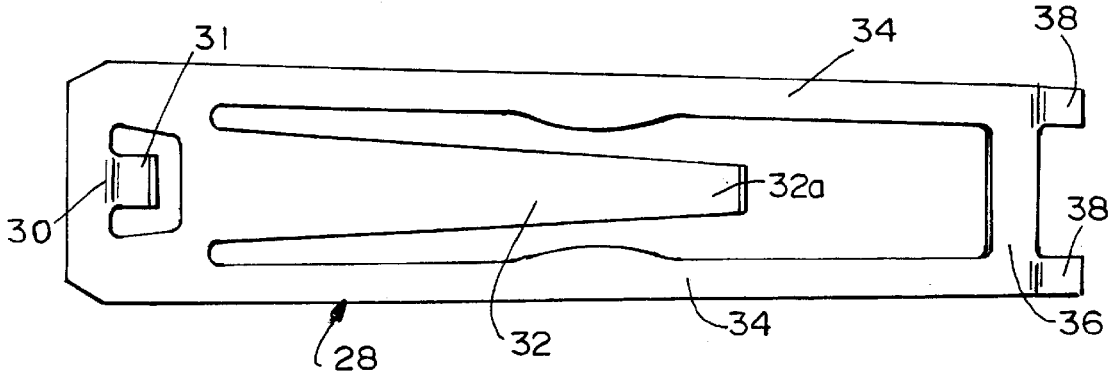
FIG. 3 is a plan or planar view of the shorting member.
Figure 4:
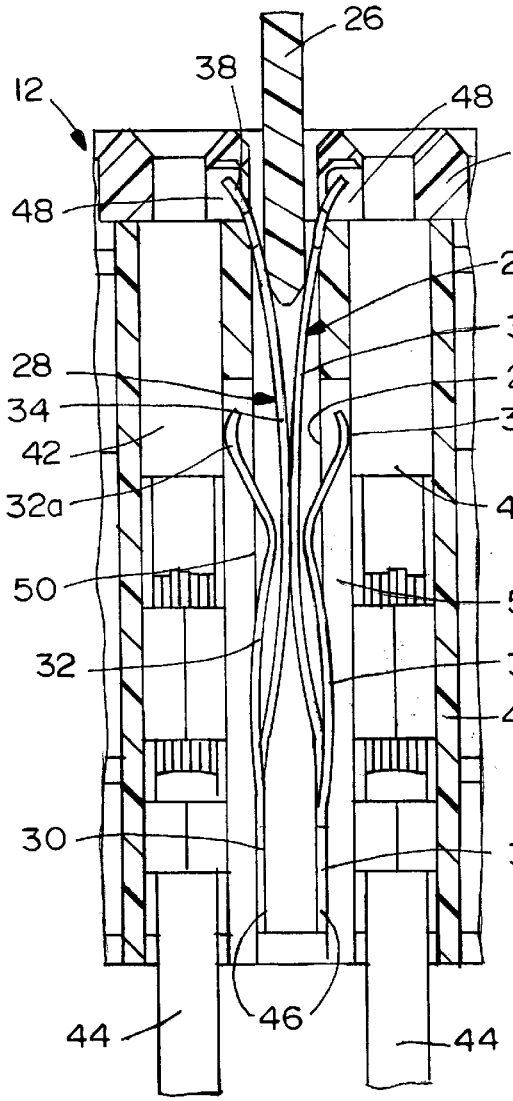
FIG. 4 is a section through the connectors just prior to mating.

The invention contemplates a shorting circuit arrangement which includes at least a pair of conductive shorting members, generally designated 28 and shown in enlarged depictions in FIGS. 2 and 3. Each shorting member is stamped and formed of conductive sheet metal material and includes a cross base portion 30 which is fixed within the housing of first connector 12, as will be described in greater detail hereinafter. A contact portion in the form of a spring arm 32 is cantilevered from base portion 30. The spring arm terminates in a contact area 32a. A pair of shorting portions in the form of a pair of spring beams 34 also are cantilevered from base portion 30 on opposite sides of contact portion 32. The distal ends of spring beams 34 are integrally joined by a cross portion 36 which includes an outwardly projecting alignment tab 38. As best seen in FIG. 2, contact portion 32, particularly contact area 32a thereof, is disposed to one side of base portion 30, whereas shorting portions 34 are bowed outwardly on the other side of the base portion FIG. 4 shows a pair of the shorting members 28 mounted within a dielectric housing 40, which forms plug portion 16 of first connector 12. The shorting members are mounted within slot 24 between a pair of adjacent terminals 42 which are connected to electrical cables 44 which form the shorting circuit of the system. Base portions 30 of the shorting members are press-fit and, thereby, fixed within grooves 46 in housing 40. Alignment tabs 38 at the opposite ends of the shorting members, are located within alignment grooves 48 at the top of the housing. Contact portions or spring arms 32 extend from fixed base portions 30 upwardly in slot 24, with contact areas 32*a* of the spring arms projecting outwardly through windows 50 in the housing and into engagement with terminals 42. Shorting portions or spring beams 34 of the shorting members extend upwardly from base portions 30, with the shorting portions of the shorting members being in engagement with each other as clearly seen in FIG. 4.

Figure 5:
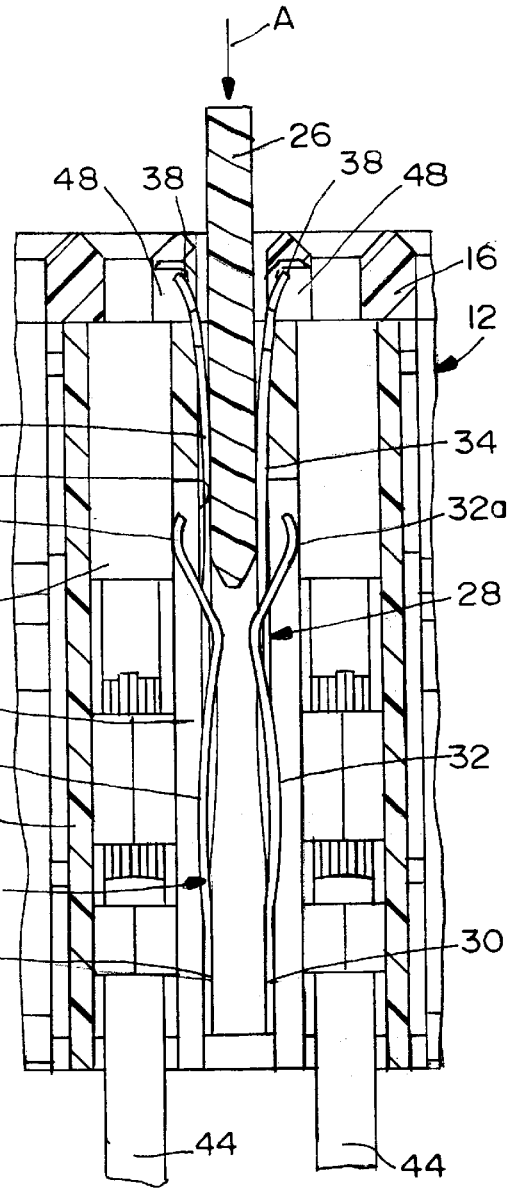
FIG. 5 is a view similar to that of FIG. 4, with the connectors mated and the shorting circuit opened.

With the arrangement of shorting members 28 shown in FIG. 4, it can be seen that the shorting portions provided by spring arms 32 are in constant engagement with terminals 42, as contact areas 32*a* of the spring arms are biased into engagement with the terminals. The shorting portions provided by spring beams 34 also are in constant biased engagement with each other, as shown, so that a short or shunting circuit is established between terminals 42 and their respective electrical cables 44, through shorting members 28. In an air bag system, this shorting circuit would deactivate the igniter to the air bag inflating system Whereas FIG. 4 shows extending rib 26 of second connector 14 (FIG. 1) about to be inserted between spring beams 34 of shorting members 28, FIG. 5 shows extending rib 26 moved in the direction of arrow "A" (the mating direction of the connectors), with the extending rib slidably received between the shorting portions provided by spring beams 34 of the shorting members. The extending rib physically separates the shorting portions of the shorting members and, with the rib being of dielectric material, electrically separates the shorting members and opens the shorting circuit between terminals 42 and their electrical cables 44. By providing two shorting portions or spring beams 32 on opposite sides of contact portion or spring arm 32, a safety redundant feature is embodied in the arrangement. In addition, while FIGS. 4 and 5 show a pair of shorting members 28 between an adjacent pair of terminals 42, additional pairs of shorting members between additional pairs of terminals can be positioned at various locations along slot 24 of first connector 12 (FIG. 1) to be opened by different portions of extending rib 26 of second connector 14.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly which includes a shorting circuit arrangement, comprising:

a first connector including a dielectric housing mounting at least a pair of adjacent terminals;

a pair of conductive shorting members mounted in the housing of the first connector between said adjacent terminals, each shorting member including a contact portion in engagement with one of said terminals and a shorting portion in engagement with the shorting portion of the other shorting member, thereby establishing an electrical shorting circuit between the terminals; and a second connector including a dielectric extending portion received between the shorting portions of the shorting members when the connectors are mated, thereby electrically separating the shorting members and opening the electrical shorting circuit between the terminals.

2. The electrical connector assembly of claim 1 wherein each shorting member is formed of metal material and said contact portion comprises a spring arm resiliently biased into engagement with the respective terminal.

3. The electrical connector assembly of claim 1 wherein each shorting member is formed of metal material and said shorting portion comprises a spring beam resiliently biased into engagement with the spring beam of the other shorting member.

4. The electrical connector assembly of claim 3 wherein each shorting member is formed of metal material and said contact portion comprises a spring arm resiliently biased into engagement with the respective terminal.

5. The electrical connector assembly of claim 4 wherein each shorting member includes a base portion fixed to the housing of the first connector, and said spring arm and said spring beam are cantilevered from the base portion.

6. The electrical connector assembly of claim 1 wherein each shorting member includes a pair of said shorting portions on opposite sides of the contact portion thereof.

7. The electrical connector assembly of claim 6 wherein each shorting member includes a base portion fixed to the housing of the first connector, and said shorting portions and said contact portion are cantilevered from the base portion.

8. The electrical connector assembly of claim 7 wherein the shorting portions of each shorting member are longer than the contact portion thereof, and distal ends of the shorting portions are integrally joined by a cross portion of the shorting member.

9. An electrical connector assembly which includes a shorting circuit arrangement, comprising:

a first connector including a dielectric housing mounting at least a pair of adjacent terminals;

a pair of substantially identical conductive shorting members mounted in the housing of the first connector between said adjacent terminals, each shorting member being stamped and formed of sheet metal material and including a base portion fixed to the housing of the first connector, a contact portion in the form of a spring arm biased into engagement with one of the terminals, and a pair of shorting portions in the form of spring beams on opposite sides of the spring arm, each spring beam being in biasing engagement with the spring beam of the other shorting member, thereby establishing an electrical shorting circuit between the terminals; and a second connector including a dielectric extending portion received between the shorting portions provided by the spring beams of the shorting members when the connectors are mated, thereby electrically separating the shorting members and opening the electrical shorting circuit between the terminals.

10. The electrical connector assembly of claim 9 wherein the shorting portions provided by the pair of spring beams of each shorting member are longer than the contact portion provided by the spring arm thereof, and distal ends of the spring beams are integrally joined by a cross portion of the shorting member.

* * * * *